US010753094B2

(12) United States Patent
Ghomi

(10) Patent No.: US 10,753,094 B2
(45) Date of Patent: Aug. 25, 2020

(54) AUXILIARY STIFFENER AND CUSTOMIZATION OF PREFABRICATED TRUSSES USING SAME

(71) Applicants: Jessica Manness Engineering Inc., Lockport (CA); Shervin Khalili Ghomi, Winnipeg (CA)

(72) Inventor: Shervin Khalili Ghomi, Winnipeg (CA)

( * ) Notice: Subject to any disclaimer, the term of this patent is extended or adjusted under 35 U.S.C. 154(b) by 0 days.

(21) Appl. No.: 16/194,982

(22) Filed: Nov. 19, 2018

(65) Prior Publication Data

US 2019/0194945 A1 Jun. 27, 2019

Related U.S. Application Data

(60) Provisional application No. 62/588,485, filed on Nov. 20, 2017.

(51) Int. Cl.

| | |
|---|---|
| ***E04C 3/18*** | (2006.01) |
| ***E04C 3/29*** | (2006.01) |
| ***E04C 3/08*** | (2006.01) |
| ***E04C 3/40*** | (2006.01) |
| ***E04C 3/04*** | (2006.01) |

(52) U.S. Cl.

CPC ..... *E04C 3/18* (2013.01); *E04C 3/08* (2013.01); *E04C 3/291* (2013.01); *E04C 3/40* (2013.01); *E04C 2003/043* (2013.01); *E04C 2003/0413* (2013.01); *E04C 2003/0447* (2013.01); *E04C 2003/0491* (2013.01); *E04C 2003/0495* (2013.01)

(58) Field of Classification Search

CPC ..... E04B 1/24; E04B 2001/2424; E04B 2001/2696; E04B 2001/2496; E04C 3/18; E04C 3/291; E04C 2003/0447; E04C 2003/0412; E04C 2003/043; E04C 3/40; Y10T 403/346

See application file for complete search history.

(56) References Cited

U.S. PATENT DOCUMENTS 297,334 A * 4/1884 Adams ..... E04G 1/14 52/638
578,403 A * 3/1897 Jeffery ..... E04B 1/2403 403/217
1,150,781 A * 8/1915 Louden ..... E04B 1/1903 403/218

(Continued)

*Primary Examiner* — Christine T Cajilig
(74) *Attorney, Agent, or Firm* — Kyle R Satterthwaite; Ryan W Dupuis; Ade & Company Inc.

(57) ABSTRACT

A length-adjustable truss stiffener is intended to be used to strengthen truss systems at locations of localized over-stress to reduce the cost from the alternative solution which is to reduce truss spacings. The stiffener consists of two or more sleeves locking around two or more components of the main truss. The sleeves mounted on different truss components are connected to one another with a length-adjustable shank. The stiffener may be used in two-dimensional or three-dimensional trusses. Of a collection of prefabricated trusses necessary to erect a structure, only a subset of one or more trusses are customized with stiffeners according to loading calculations predicting failure of that subset under required loading conditions, while all other trusses are installed in their original prefabricated state.

22 Claims, 6 Drawing Sheets

(56) References Cited

U.S. PATENT DOCUMENTS 2,001,215 A * 5/1935 Ruppel ..... E04B 1/24 52/653.2
2,302,101 A * 11/1942 Boydstun ..... E04B 1/10 52/210
3,209,508 A * 10/1965 Hunnebeck ..... E01D 21/00 52/632
4,682,460 A * 7/1987 Reetz ..... E04C 3/292 52/632
4,691,399 A * 9/1987 Kim ..... E01D 22/00 14/10
5,761,873 A * 6/1998 Slater ..... E04B 1/08 52/633
6,026,613 A * 2/2000 Quiring ..... E04B 7/08 52/63
6,056,240 A * 5/2000 Hagenlocher ..... B64B 1/08 244/125
6,584,741 B1 * 7/2003 Hatzinikolas ..... E04C 3/16 29/897.35
6,877,291 B2 * 4/2005 Shamroukh ..... E04B 7/022 403/232.1
7,171,792 B2 * 2/2007 Windahl ..... E04B 1/24 52/633
9,587,401 B1 * 3/2017 Benton ..... E04C 3/02
2010/0192506 A1 * 8/2010 Allred, III ..... E04C 3/08 52/655.1
2012/0138559 A1 * 6/2012 Huff ..... E04C 3/10 212/175
2012/0216475 A1 * 8/2012 Safari Kermanshahi ..... E04C 3/086 52/309.4
2012/0272608 A1 * 11/2012 Groenesteyn ..... E04C 3/18 52/657
2018/0202162 A1 * 7/2018 Charest ..... E01D 6/00

* cited by examiner

AUXILIARY STIFFENER AND CUSTOMIZATION OF PREFABRICATED TRUSSES USING SAME

CROSS-REFERENCE TO RELATED APPLICATIONS

This application claims benefit under 35 U.S.C. 119(e) of U.S. Provisional Application No. 62/474,374, filed Mar. 21, 2017, the entirety of which is incorporated herein by reference.

FIELD OF INVENTION

The present invention relates to the design and construction of truss-based structures, and more particularly to use of prefabricated trusses of predetermined load capacity during such the design and construction.

BACKGROUND OF INVENTION

Trusses are commonly used in the construction industry. Trusses are typically consisted of an upper chord element and a lower chord element inter connected by plurality of web members. Trusses are used in variety of structures from bridges to residential houses. Specially in buildings, it is common to combine identical trusses with equal spacing to create a load-resisting system such as roof of residential houses or frame of fabric buildings.

In the case of combining identical trusses, it is common to prefabricate the trusses in a manufacturing shop and transfer them as a whole unit or in several parts to the construction site. Prefabricating trusses provides superior quality control, cost efficiency and precision compared to the construction in the job site.

In some fields of application, such as housing and fabric buildings, truss manufactures provide a variety of pre-designed trusses with defined load capacity to be used in typical loading situations. Moreover, some truss manufacturers provide modular truss systems that can be combined to accommodate to variety of structural geometries. The modular systems, for example, are common in the field of pre-made tubular arched steel trusses used as the load resisting systems in fabric buildings.

In such cases the modular systems are optimised for a variety of typical loading scenarios; however, the optimization for every load combination is not possible. Therefore, there might be load cases that result in localized failure of one or a few elements of the truss assembly under extreme loading while the rest of the elements are still far from their maximum allowable capacity. Since factory-level customization of the truss for each individual case may not be cost effective, in most cases the solution is to increase the number of trusses in length of the building by reducing the bay spacing (i.e. the distance from one truss assembly to the next). This will result in a structure in which the majority of trusses are over-designed relative to their experienced loads just to correct overloading of a small subset of the trusses that might otherwise fail.

Therefore, this conventional practice of increasing the overall number of trusses and reducing the bay spacing between trusses can be considered inefficient from both a cost and materials standpoint.

Accordingly, it would be desirable to provide improved or alternative approaches to construction projects using prefabricated trusses.

SUMMARY OF INVENTION

According to a first aspect of the invention, there is provided, in combination, a stiffener and an arch-shaped steel truss, said arch-shaped steel truss having a prefabricated form comprised of first and second arcuate chords and a plurality of web members that are welded to and span between said first and second arcuate chords, said stiffener comprising a shank having opposing first and second ends, a first cradle connected to said shank at the first end thereof and shaped to embrace a first portion of the arch-shaped steel truss situated at or adjacent the first arcuate chord on an inner side thereof, and a second cradle connected to said shank at the second end thereof and operable to embrace a second portion of the arch-shaped steel truss situated at or adjacent the second arcuate chord on an inner side thereof.

According to a second aspect of the invention, there is provided a method of customizing an arch-shaped steel truss having a predetermined loading capacity attributed to a prefabricated form of said arch-shaped steel truss that comprises a first arcuate chord, a second arcuate chord and a plurality of existing web members welded to and spanning between said first and second arcuate chords, said method comprising determining load capacity requirements for an intended application of said arch-shaped steel truss, and if said load capacity requirements exceed said predetermined loading capacity, prescribing post-fabrication installation of an auxiliary stiffener to said arch-shaped steel truss in a position bracing against a first portion of the arch-shaped truss situated at or adjacent the first arcuate chord on an inner side thereof, and bracing against a second portion of the arch-shaped truss situated at or adjacent the second arcuate chord on an inner side thereof, in order to augment the existing web members spanning between the first and second arcuate chords of said arch-shaped steel truss, and thereby increase the loading capacity of said arch-shaped steel truss beyond the predetermined loading capacity attributed to the prefabricated form.

According to a third aspect of the invention, there is provided a method of constructing a truss-based structure, said method comprising obtaining a collection of prefabricated trusses each having a predetermined load capacity, installing one or more auxiliary stiffeners on a subset of said collection for which said predetermined load capacity is exceeded by loading requirements of the truss based structure being constructed.

Preferred embodiments of the present invention employ use of a simple and easily installed stiffener to strengthen only vulnerable elements of a truss-based structure without the need for increasing the overall number of trusses in the structure. This approach can be used to significantly reduced the material used in the building, which in turn can decrease the cost, construction time and weight of the structure.

Embodiments of the present invention employ the stiffener to strengthen a chord member at an overloaded location determined through structural analysis by firstly providing additional lateral stability, and secondly providing a load path to distribute the load in overloaded section to other parts of the truss, typically the chord on the opposite side. In other words, once installed, the stiffener is interacting with the other original components of the truss as an additional web member that supplements the original web members of the prefabricated truss.

As mentioned earlier, many prefabricated truss manufacturers provide a series of pre-designed trusses with preset geometrical configuration to reduce the need for custom made trusses to reduce the cost. This is an effective way to increase efficiency of the prefabricated trusses. In order to follow the same approach, embodiments of the present invention employ versatility to accommodate a wide range of main truss geometries.

Embodiments of the present invention are therefore useful:

- to strengthen certain locations of a prefabricated truss by providing addition webbing member;
- to provide a webbing member that is adjustable and compatible with trusses with various geometrical configuration; and
- to provide a webbing member that can resist both tension and compression forces.

DETAILED DESCRIPTION OF INVENTION

Figure 1A:
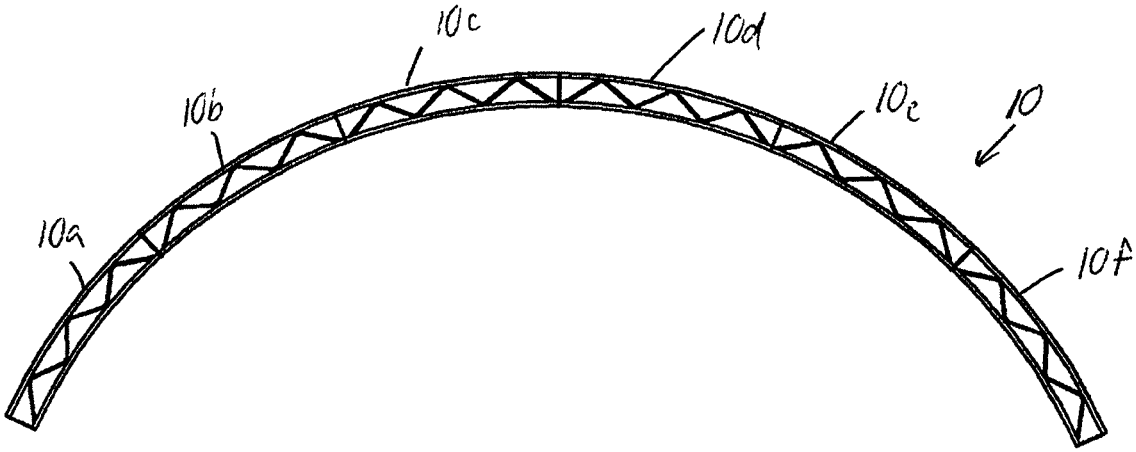
FIG. 1A is an elevational view of an arbitrary assembly of tubular steel arched trusses to which aspects of the present invention may be applied.

FIG. 1 schematically demonstrates an exemplary context in which the present invention is particularly useful. FIG. 1A illustrates an arch assembly 10 formed by a plurality of prefabricated arch-shaped tubular steel trusses 10*a*, 10*b*, 10*c*, 10*d*, 10*e*, 10*f*. Each truss has a tubular steel upper chord 12 following a slightly curved arcuate path, a tubular steel lower chord 14 following a slightly curved arcuate path in parallel relation to the upper chord, and a plurality of tubular steel web members 16*a*, 16*b*, 16*c*, 16*d*, 16*e*, 16*f* each having its two opposing ends respectively affixed, e.g. welded, to the upper and lower chords so as to span linearly therebetween at an oblique angle thereto. The arch assembly 10 is thus of modular construction, having been assembled from a plurality of identical or similarly configured prefabricated trusses, each thus defining a respective module of the modular arch assembly.

Figure 1B:
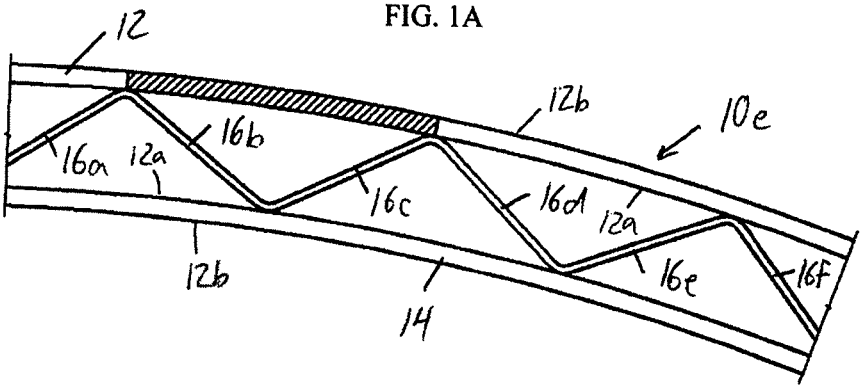
FIG. 1B illustrates a partial elevational view of a single prefabricated truss within the assembly of FIG. 1A for which localized failure of its upper chord is anticipated under mathematically modeled loading conditions.

Before actual construction of a building or other structure with such modular truss arches, a computer implemented mathematical model of the structure is created using suitable analytical modelling software, and then subject to finite element analysis under simulated loading conditions, for example which may be based on prescribed building codes of a particular jurisdiction in which the structure is to be erected. FIG. 1B illustrates the results from one such simulation, which reveals an anticipated failure of the upper chord 12 of prefabricated truss 10*d* in the arch assembly 10 at a localized area (hashed area) between web members 16*b* and 16*c* due to loading of this truss that exceeds the predetermined load bearing capacity of this prefabricated truss.

The conventional solution to such anticipated failure detection would be to increase the number of arch assemblies used in the mathematical model of the structure, and reduce the bay spacing between each pair of adjacent arch assemblies of the model so that the simulated load is distributed among a greater number of structural arches. The load simulation is then repeated, and if no failures are detected, then this increased number of arches and reduced bay spacing is prescribed for the actual physical construction of the structure.

In the present invention, rather than increase the number of arches, the failed truss in the computer model is instead remodelled with an additional web member to stiffen the arch and reinforce the chord thereof at the location thereon at which the anticipated failure was detected in the original simulation. While the other modeled trusses remain in their original unmodified form reflecting the truss manufacturer's normal prefabricated truss, the remodelled truss with the additional web member added to the prefab model thus represents a customized truss of increased loading capacity for the particular application being designed for.

The loading simulation is repeated with the customized truss model in place among the other unmodified prefab truss models of the overall structural model. If no anticipated failure is detected in this re-iteration of the simulated loading analysis, then the physical production of a customized truss matching the custom truss model is prescribed for the construction of the physical truss-based structure.

However, rather than requiring modification of the standardized manufacture of the prefabricated trusses to generate such a one-off customized truss, the present invention instead employs the installation of a novel auxiliary stiffener onto a standard prefabricated truss in order to serve as the added web member prescribed by the analytical model to meet the particular project's loading requirements.

The appended drawings show numerous possible implementations of the auxiliary stiffener to be used at the anticipated locations of localized truss failure indicated by the structural analysis to increase the capacity of that particular area. The primary components of the stiffener include two sleeves 22, 24 connected together by a length-adjustable shank 26. The sleeves lock around portions of the prefabricated truss at or near the upper and lower chords 12, 14 thereof. The length of the shank is adjusted according to the distance between the chords in the particular truss being customized with the stiffener. The length adjustability of the shank thus enables use of the stiffener of on trusses of different height.

As outlined in more detail below with reference to the different illustrated embodiments, the shank can reside at a fixed 90-degree angle with respect to the sleeves, or at any other fixed or adjustable angle. Moreover, installation of the stiffener can be implemented by a single sleeve on each chord, or by a single sleeve on one chord in conjunction with multiple sleeves on the opposite chord, in which case multiple shanks are used to connect the single sleeve on the first chord to each of the sleeves on the opposite second chord.

Also, while the examples provided in the accompany drawings are illustrated in relation to two-dimensional planar trusses, it will be appreciated that the principles of the present invention may also be effectively used in a three-dimensional spatial truss as well. Likewise, the illustrated embodiments are presented in an exemplary context only, and other variations on the illustrated designs may be employed within the scope of the present invention.

Figure 2A:
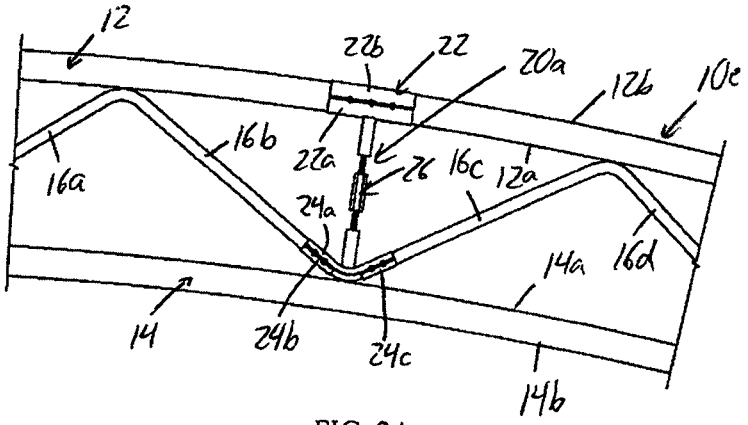
FIG. 2A is a partial elevation view of the prefabricated truss of FIG. 1B after customization thereof with an auxiliary stiffener according to a first embodiment of the present invention in order to achieve sufficient loading capacity to prevent the anticipated failure.

FIG. 2A illustrates installation of a first embodiment stiffener 20*a* on the prefabricated truss 10*e* of FIG. 1B. In this embodiment, the first sleeve 22 is a linear sleeve that lies at ninety degrees to the shank 26 and is locked around the upper chord 12 of the prefabricated truss 10*e*. The second sleeve 24 is a V-shaped sleeve configured to lock around the pair of adjacent web members 16*b*, 16*c* that meet one another at the lower chord 14 at a point thereon lying opposite the first sleeve placed at the upper chord's area of anticipated failure.

The linear first sleeve in the first embodiment has a two-piece construction, with a first shank-attached sleeve member 22*a* and a first cooperating sleeve member 22*b* selectively fastenable to the first shank-attached sleeve member 22*a*. In use of the stiffener, the shank-attached sleeve member 22*a* embraces the inner side 12*a* of the upper chord that faces the lower chord, while the cooperating sleeve member 22*b* embraces the opposing outer side 12*b* of the upper chord. The two sleeve members thus cooperatively form a closed sleeve around the upper chord 12 of the prefabricated truss.

To enable this fastening together of the two sleeve members 22*a*, 22*b* around the upper chord 12 of the truss, each sleeve member 22*a*, 22*b* features a central cradle-shaped arcuate span 28 of semi-cylindrical form, and a pair of fastening flanges 30 jutting laterally outward from the central span 28 at the opposite ends of the central span's arcuate cross-section. Threaded screw or bolt fasteners 32 are passed through aligned holes in the fastening flanges 30 of the two sleeve members and are respectively mated with matching threaded nuts 34 in order to tighten the first sleeve in closed condition around the upper chord 12 of the truss 10*e*.

The V-shaped second sleeve 24 in the first embodiment has a second shank-attached sleeve member 24*a* of V-shaped configuration having two wings or halves 36, 38 that diverge from one another on opposite sides of the shank 26 toward the opposing first end of the shank. Each wing of the V-shaped shank-attached sleeve member 24*a* has the same cradle and flange structure described above for the linear first sleeve 22. Instead of a singular cooperating sleeve member like that of the linear sleeve 22, the V-shaped sleeve 24 instead features a pair of cooperating sleeve members 24*b*, 24*c*, one for each wing or half of the V-shaped shank-attached sleeve member 24*a*. Each cooperating sleeve member 24*b*, 24*c* once again has the same cradle and flange structure as the other sleeve members, but is of shorter axial length than the singular cooperating sleeve member 22*b* of the linear sleeve 22. Each cooperating sleeve member 24*b*, 24*c* is fastened to a respective wing or half 36, 38 of the V-shaped shank-attached sleeve member 24*a*.

Figure 2B:
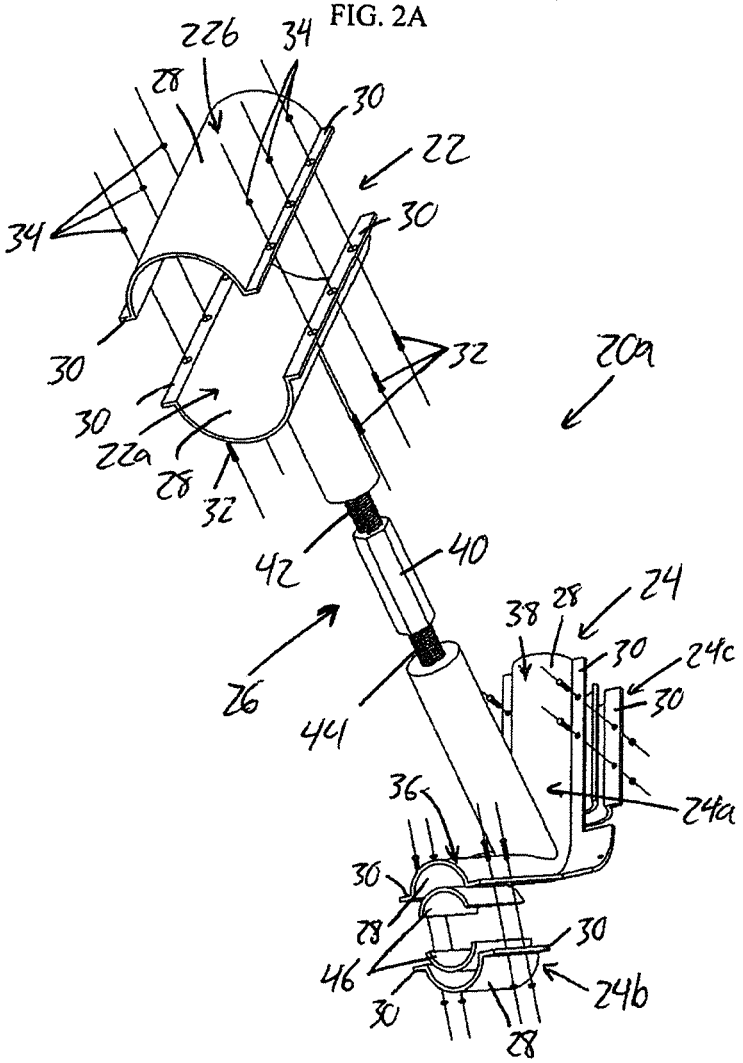
FIG. 2B is a partially exploded perspective view of the auxiliary stiffener of FIG. 2A.

The mechanism used to adjust the height or length of the shank 26 that interconnects the sleeves is also shown in FIG. 2, and resembles a turnbuckle. The shank thus features a central nut 40 into which oppositely threaded first and second screw shafts 42, 44 are engaged so that the two screw shafts reach outwardly from the central nut 40 toward the opposing first and second ends of the shank at which the first and second sleeves 22, 24 are carried. The screw shafts 42, 44 have opposite threads (one with right-hand thread, and one with left-hand thread), whereby the shank can be extended or shortened by turning the centre nut 40 in opposite directions.

FIG. 2A shows the installed state of the first embodiment stiffener 20*a* on the truss 10*e*. The two sleeve members 22*a*, 22*b* of the first sleeve 22 embrace about the inner and outer sides of the upper chord 12 of the truss so as to cooperatively close in a tightened circumferential relation around the upper chord at the anticipated failure area thereof, thus clamping the stiffener to this area of the upper chord. The shank-attached sleeve member 24*a* of the V-shaped second sleeve 24 embraces against a pair of adjacent web members 16*b*, 16*c* at the upper sides thereof that face the upper chord, and more particularly at end-adjacent areas of these web members near the V-shaped intersection point where these two web members meet at the inner side 14*a* of the lower chord 14. The two cooperating sleeve members 24*b*, 24*c* of the of the V-shaped sleeve embrace respectively about the two adjacent web members 16*b*, 16*c* at these intersection-adjacent areas, but on the lower sides of the web members that face the lower chord 14 of the truss. The V-shaped sleeve 24 thus clamps the stiffener to these adjacent web members 16*b*, 16*c* at end-adjacent areas thereof near which they are affixed to the lower chord. So although not directly clamped to the lower chord, the V-shaped sleeve 24 effectively clamps the stiffener to the lower chord in an indirect manner via these adjacent web members 16*b*, 16*c* that meet one another at the lower chord.

As described above, each sleeve is tightened by means of a series of threaded fasteners and nuts on opposite sides of the truss component (chord, web member) to which the sleeve is clamped. The number of bolts on the sleeves is calculated based on the required clamping force and fixity of the sleeves. In the illustrated example, the clamping configuration uses three bolts on each side of the first linear sleeve and two bolts on each side of each wing of the second V-shaped sleeve. Alternatively, each sleeve or wing may be tightened by as few as one bolt on each side of the sleeve/wing. The first configuration using multiple fasteners per side provides some level of resistance against moment and provides relatively stiffer connection compared to the second single-fastener configuration.

A layer of thin rubber padding 46 may be placed between each sleeve member or wing and the chord or web member around which the sleeve is closed. This can be beneficial to increase the resistance against slippage of the sleeve along the chord or web member. Moreover, the rubber pad 46 can prevent possible damage to the main truss members that can occur during fastening of the sleeves' nuts due to mismatch between the exterior surface of the truss chord/web and the concave surfaces of the sleeve cradles that could occur due to imperfections in the manufacture of the sleeves.

Figure 3A:
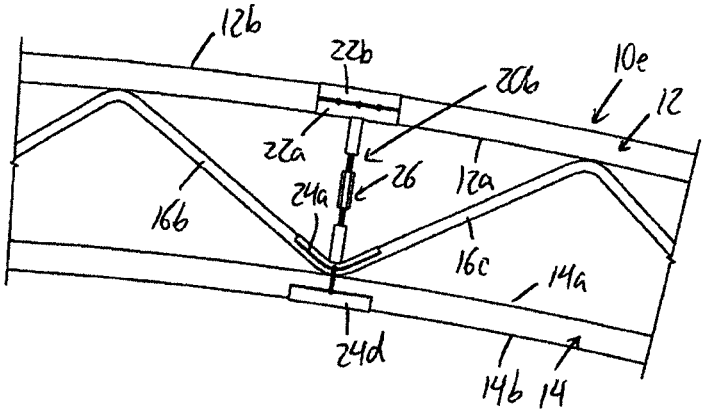
FIG. 3A is a partial elevation view of the prefabricated truss of FIG. 1B after customization thereof with an auxiliary stiffener according to a second embodiment of the present invention.
Figure 3B:
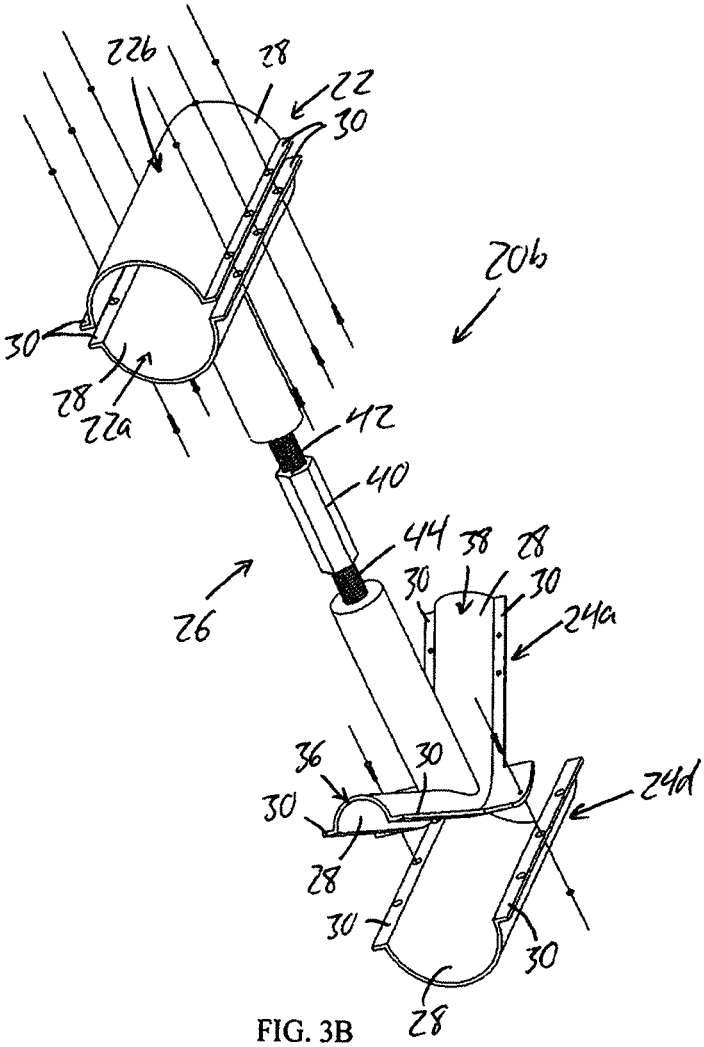
FIG. 3B is a partially exploded perspective view of the auxiliary stiffener of FIG. 3A.

In the first embodiment shown in FIG. 2, the lower sleeves are locked only around web members of the main truss so as to indirectly lock the stiffener to the lower chord. However, FIG. 3 illustrates a slightly varied second embodiment 20*b* whose V-shaped second sleeve instead locks around the lower chord 14 and the V-shaped intersection of the web members 16*b*, 16*c*. In this variant, the second sleeve once again features a V-shaped shank-attached sleeve member 24*a*, but instead of a pair of shorter cooperating shank members 24*b*, 24*c*, the second embodiment stiffener 20*b* uses a singular cooperating sleeve member 24*d* of the same or similar length as the first cooperating sleeve member 22*b* of the linear sleeve 22. So, this singular second cooperating sleeve member 24*d* embraces over the outer side 14*b* of the lower chord, as shown in FIG. 3A. This embodiment thus has the second sleeve clamped around both the lower chord and the pair of adjacent web members 16*b*, 16*c*.

Figure 4A:
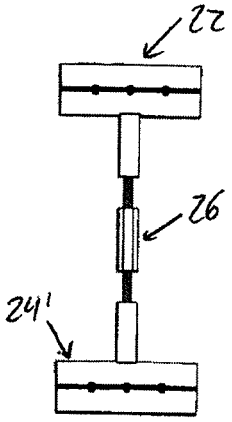
FIGS. 4A and 4B are side and end elevational views of a third embodiment auxiliary stiffener.
Figure 4B:
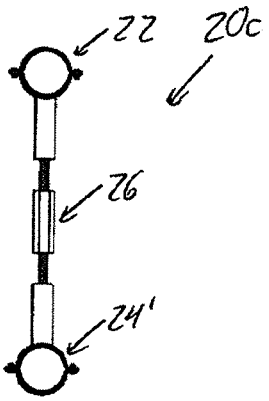
Figure 4C:
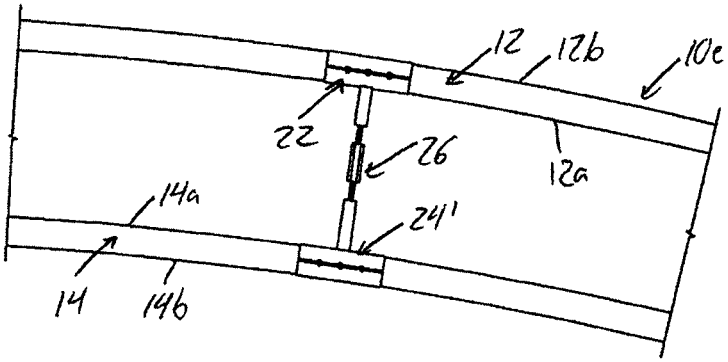
FIG. 4C is a side elevational view illustrating installation thereof on the chords of a prefabricated truss.

FIG. 4 shows a third embodiment stiffener 20*c* featuring the same linear first sleeve 22 as the preceding embodiments, but replacing the V-shaped second sleeve with a linear sleeve of the same type as the first sleeve 22. The second sleeve 24' in this embodiment thus has a shank-attached sleeve member lying perpendicular to the shank to embrace the inner side 14*a* of the lower chord, and a cooperating sleeve member fastened to the shank-attached sleeve member and embracing the outer side 14*b* of the lower chord. This embodiment is useful where there's available area unoccupied by web members on the inside of the second chord 14 at a location lying opposite the failure-anticipated area on the first chord 12, as shown in FIG. 4C.

In the first two embodiments, at least one of the sleeves was positioned at the intersection of the web members with one of the truss chords, in which case the original web members of the truss provide lateral constraint to resist or prevent the sleeves from sliding along the chord's axis. If no such lateral constraint is available from body of the main truss, the sleeves may be secured in their position on the chords by providing increased frictional resistance between the sleeves and the chords. In such case, the friction between the chord's surface material and the thin rubber pads 46 preferably included inside the sleeves, or between chord's surface material and the sleeve's surface material if no internal pad is provided, can be increased by tightening the fasteners 32 to increase the clamping force.

Alternatively, the sleeves may be permanently attached to the chords by welding to prevent slippage of the sleeves. However, fastener-based clamping of the sleeves without welded attachment may be preferable to minimize the need for skilled welder installation of the stiffener, and/or minimize the need to install the stiffener in a workshop, factory or other particularly equipped environment. Purely fastened installation of the stiffener maximizes the ease of in-situ installation of the stiffener at the construction site of the building or other structure without specialized labour. This way, a manufacturer, supplier or distributor need not pre-install the stiffeners, and can simply ship, deliver or supply the builder with a customized modular kit that provides the exact necessary collection of prefabricated trusses for assembly, plus the exact number of necessary stiffeners prescribed by the structural analysis.

For example, a building or structural contractor may obtain the building/structural design constraints (building size, etc.) from a customer, determine a required collection of prefabricated trusses required, build the analytical model and run the simulations thereon to identify one or more trusses that will require stiffening, and then place an order form the manufacturer, supplier or distributor that includes the necessary collection of prefabricated trusses, and the required number of stiffeners to be delivered to the construction site. No specialized manufacturing costs are incurred, and the size and weight of the relatively small stiffeners compared to the trusses themselves reduces shipping costs compared to the conventional solution of ordering an increased quantity of trusses.

Figure 5:
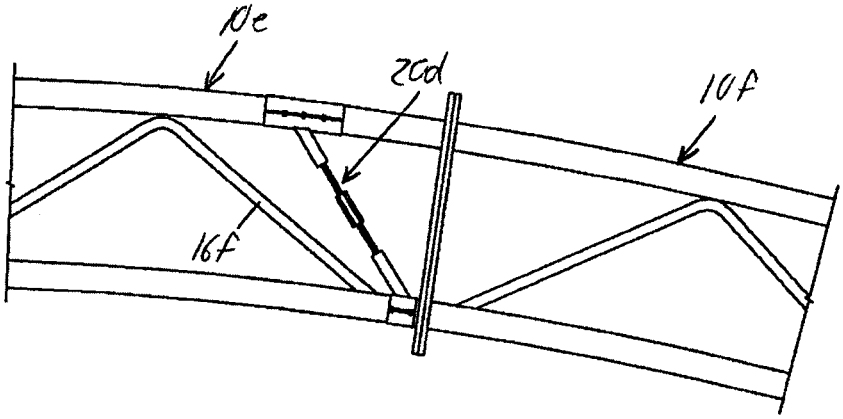
FIG. 5 is a side elevational view illustrating installation of a fourth embodiment auxiliary stiffener of the present invention on a prefabricated truss.

FIG. 5 shows a fourth embodiment stiffener 20*d* with linear sleeves at both ends like the third embodiment shown in FIG. 4, but with each sleeve residing at an oblique angle relative to the shank 26 to accommodate various geometrical configuration of chords and web members among prefabricated trusses. This embodiment also illustrates that one sleeve may be shorter than the other to accommodate other constraints of the truss at various areas where installation of the stiffener may be required. The illustrated example in Figure features placement of the shorter sleeve between a chord-attached end of a first or final web member 16*a*, 16*f* of the truss and the nearest end of the truss. The shorter of the two sleeves resides adjacent a flange-equipped end of the truss 10*e*, where the truss is bolted to the next truss 10*f* in the arch assembly.

Figure 6:
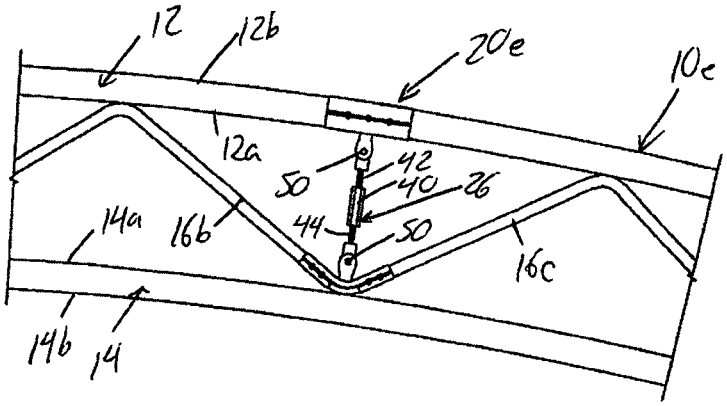
FIG. 6 is a side elevational view illustrating installation of a fifth embodiment auxiliary stiffener of the present invention on a prefabricated truss.

In the preceding embodiments, the shank-attached sleeve members are rigidly fixed to the shank at a static angle. FIG. 6 shows a fifth embodiment stiffener 20*e* with the same linear first sleeve 22 and V-shaped second sleeve 24 as the first embodiment in FIG. 2, but has each of its shank-attached sleeve members pivotally coupled to the shank near the respective end thereof by a pivot pin 50 that passes perpendicularly through the shank in a direction that is perpendicularly transverse to the plane of the truss when the stiffener is installed. This way, the shank-attached sleeve member is pivotable relative to the shank a pivot axis lying in this transverse direction. Accordingly, the angle at which the shank-attached sleeve member resides relative to the shank is variable and adjustable to allow installation of the shank in different positions and orientations on the truss as may be dictated by the truss design and stiffening requirements of any given application. The pivotal configuration of the sleeves together with the length-adjustable shank accommodates a wide range of geometrical truss configurations. The pinned connection also eliminates unwanted application of bending moments to the truss components.

Figure 7:
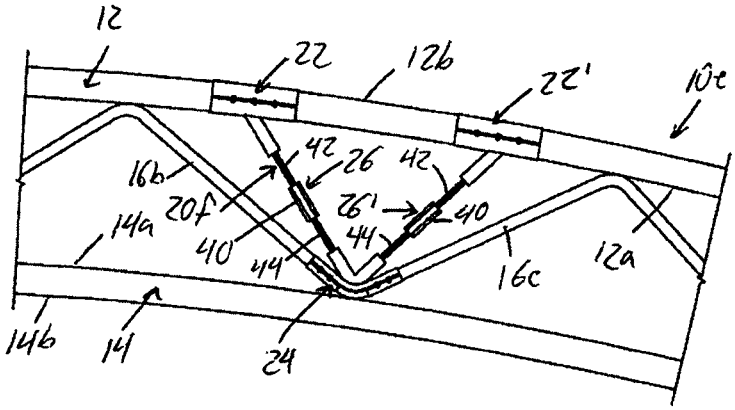
FIG. 7 is a side elevational view illustrating installation of a sixth embodiment auxiliary stiffener of the present invention on a prefabricated truss.

FIG. 7 shows a sixth embodiment stiffener 20*f* as another example where the shank and linear sleeve 22 lie at oblique angles to one another, in this case at a 45-degree angle. This embodiment also demonstrates a multi-shank construction of the stiffener, where a V-shaped second sleeve 24 of type described in relation to FIG. 2 or 3 is employed at a second end of a first shank 26 whose opposing first end features the obliquely oriented linear first sleeve 22 fitted on the upper chord of the truss. A second shank 26' is also attached to the V-shaped second sleeve 24, and reaches upwardly therefrom at a diverging angle away from the first shank 26 toward the upper chord 12. The end of the second shank 26' opposite the V-shaped second sleeve 24 carries a linear third sleeve 22' of the same type as the first sleeve 22. This third sleeve, likewise clamps around the upper chord of the truss. This embodiment thus uses the pair of diverging shanks 26, 26' that share a common sleeve at one end to clamp to the one chord 14 at a singular location, and a pair of respectively supported sleeves 22, 22' at the other ends of the diverging shanks to clamp to the opposing chord at two discretely spaced locations therealong.

Figure 8A:
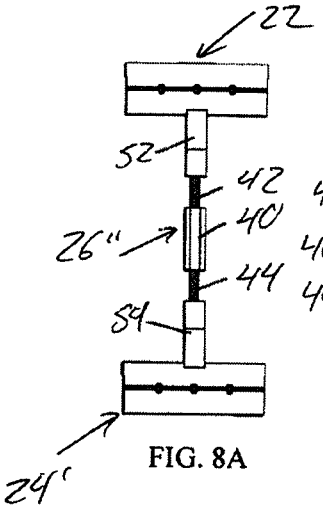
FIGS. 8A and 8B are side and end elevational views of a seventh embodiment auxiliary stiffener.
Figure 8B:
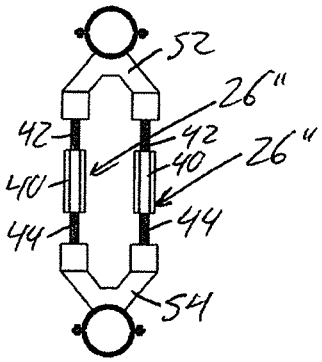

FIG. 8 shows a seventh embodiment in which the stiffener 20*g* once again has a multi-shank configuration, but not a diverging-shank, three-sleeve configuration like the sixth embodiment of FIG. 7. Instead, the seventh embodiment stiffener 20*g* features a pair of offset parallel shanks 26" symmetrically offset to respective sides of a central plane that bisects the two sleeves. Each shank is once again adjustable in length using the same turnbuckle screw mechanism described above. A first yoke 52 joins the two offset shanks together at the first ends thereof and carries the first sleeve 22 thereon, while a second yoke 54 likewise joins the two offset shanks together at the second ends thereof and carries the second sleeve 24' thereon.

Alternatively, the two shanks 26" may be interpreted as two legs of a double-legged or bifurcated shank, each parallel leg of which incorporates a respective length adjustment mechanism to enable expansion and collapse of the stiffener's height.

Figure 8C:
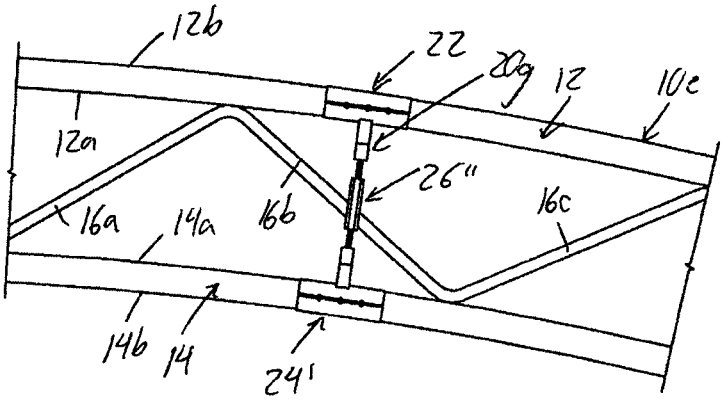
FIG. 8C is a side elevational view illustrating installation thereof on the chords of a prefabricated truss.

The two offset shanks or legs 26" are thus laterally spaced apart from one another so that this gap space between the shanks can accommodate an existing original web-member 16*b* of the prefabricated truss between the two shanks when the stiffener is installed on the truss, as shown in FIG. 8C. This embodiment is particularly useful in applications where the existing web configuration of the prefabricated truss would otherwise interfere with placement of a stiffener whose shank lies in coplanar, rather than offset, relation to the central plane on which the sleeves are centered.

The illustrated example of the offset multi-shank (or bifurcated single-shank) embodiment in FIG. 8 shows rigidly fixed sleeves of perpendicular orientation to the shank, but other fixed-angle orientations or a variable angle pivotal configuration may alternatively be employed, just like in the earlier single, non-bifurcates shank embodiments.

The preferably length-adjustable nature of the shank in each of the preceding embodiments is not only useful in relation to adjustment of the stiffener size to fit trusses of different height, but also enables insertion of the shank and the shank-attached sleeve members into the inter-chord space of the truss while the shank is in a collapsed state, whereupon the length adjustment mechanism is used to expand the shank and force each of the shank-attached sleeve members into abutment against the respective chord or web members. At this point, the cooperating sleeve members are then fastened in place to complete the installation of the stiffener, which is then held securely in place and is also able to handle tensional loads due to the fully closed state of each sleeve around one or components of the truss at or near the chords thereof.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. In combination, a stiffener and an arch-shaped steel truss, said arch-shaped steel truss having a prefabricated form comprised of first and second arcuate chords and a plurality of web members that are welded to and span between said first and second arcuate chords, said stiffener comprising a shank having opposing first and second ends, a first cradle connected to said shank at the first end thereof and shaped to embrace a first portion of the arch-shaped steel truss situated at or adjacent the first arcuate chord on an inner side thereof, and a second cradle connected to said shank at the second end thereof and operable to embrace a second portion of the arch-shaped steel truss situated at or adjacent the second arcuate chord on an inner side thereof; wherein one of the cradles is configured to embrace two adjacent web members of the prefabricated truss at or adjacent a meeting point at which said two web members diverge from one of said arcuate chords.

2. The combination of claim 1 wherein the stiffener further comprises a first cooperating sleeve member fastenable to the first cradle to cooperatively define therewith a first closed sleeve therewith around the first portion of the arch-shaped steel truss.

3. The combination of claim 2 wherein the stiffener further comprises a second cooperating sleeve member fastenable to the second cradle to cooperatively define a closed second sleeve therewith around the second portion of the arch-shaped truss.

4. The combination of claim 2 wherein the first cooperating sleeve member comprises a cradle-shaped central span for embracing about the first portion of the arch-shaped truss, and a respective pair of fastening flanges jut laterally outward from each of the first cradle and the cradle-shaped central span of the cooperating sleeve member for fastening together of the first cradle and the first cooperating sleeve member at the respective fastening flanges thereof.

5. The combination of claim 1 wherein at least one of the first and second cradles resides at an oblique angle to the shank.

6. The combination of claim 1 wherein the first and second cradles are differently configured.

7. The combination of claim 1 wherein said one of the cradles comprises a V-shaped cradle attached to the shank and having two wings that diverge on opposite sides of said shank to respectively embrace the two adjacent web members.

8. The combination of claim 7 wherein the stiffener further comprises a cooperating linear sleeve member configured for fastening the V-shaped cradle in a position embracing the first or second arcuate chord of the arch-shaped steel truss at an outer side thereof opposite the meeting point of the adjacent web members.

9. The combination of claim 7 wherein the stiffener further comprises a pair of cooperating linear sleeve members configured for fastening the V-shaped cradle in positions respectively embracing the adjacent web members on respective opposing sides of the meeting point of said the adjacent web members.

10. The combination of claim 1 wherein the shank is length-adjustable.

11. The combination of claim 10 wherein said shank comprises a screw-based length adjustment mechanism.

12. The combination of claim 11 wherein said screw-based length adjustment mechanism comprises a threaded nut and first and second screw shafts that extend oppositely of one another from said threaded toward the first and second ends of the shank, said first and second screw shafts having opposing left and right handed threads.

13. The combination of claim 1 wherein the first and second cradles are pivotally coupled to the shank to enable variation of an angle between the shank and each of said first and second cradles.

14. In combination, a stiffener and an arch-shaped steel truss, said arch-shaped steel truss having a prefabricated form comprised of first and second arcuate chords and a plurality of web members that are welded to and span between said first and second arcuate chords, said stiffener comprising a shank having opposing first and second ends, a first cradle connected to said shank at the first end thereof and shaped to embrace a first portion of the arch-shaped steel truss situated at or adjacent the first arcuate chord on an inner side thereof, and a second cradle connected to said shank at the second end thereof and operable to embrace a second portion of the arch-shaped steel truss situated at or adjacent the second arcuate chord on an inner side thereof; wherein said shank is one of two shanks spanning between the first and second cradles and laterally spaced from one another so as to span across a webbed area of the arch-shaped steel truss on opposite sides thereof.

15. In combination, a stiffener and an arch-shaped steel truss, said arch-shaped steel truss having a prefabricated form comprised of first and second arcuate chords and a plurality of web members that are welded to and span between said first and second arcuate chords, said stiffener comprising a shank having opposing first and second ends, a first cradle connected to said shank at the first end thereof and shaped to embrace a first portion of the arch-shaped steel truss situated at or adjacent the first arcuate chord on an inner side thereof, and a second cradle connected to said shank at the second end thereof and operable to embrace a second portion of the arch-shaped steel truss situated at or adjacent the second arcuate chord on an inner side thereof; wherein the stiffener further comprises a second shank to which the second cradle is connected at one end of said second shank; and a third cradle connected or connectable to said second shank at an opposing end thereof;

wherein the shanks diverge from the second cradle toward the first and third cradles to enable placement of both of said first and third cradles on the first arcuate chord of the arc-shaped truss.

16. A method of customizing an arch-shaped steel truss having a predetermined loading capacity attributed to a prefabricated form of said arch-shaped steel truss that comprises a first arcuate chord, a second arcuate chord and a plurality of existing web members welded to and spanning between said first and second arcuate chords, said method comprising determining load capacity requirements for an intended application of said arch-shaped steel truss, and if said load capacity requirements exceed said predetermined loading capacity, prescribing post-fabrication installation of an auxiliary stiffener to said arch-shaped steel truss in a position bracing against a first portion of the arch-shaped truss situated at or adjacent the first arcuate chord on an inner side thereof, and bracing against a second portion of the arch-shaped truss situated at or adjacent the second arcuate chord on an inner side thereof, in order to augment the existing web members spanning between the first and second arcuate chords of said arch-shaped steel truss, and thereby increase the loading capacity of said arch-shaped steel truss beyond the predetermined loading capacity attributed to the prefabricated form; wherein said auxiliary stiffener comprises a shank having opposing first and second ends, a first cradle connected to said shank at the first end thereof and shaped to brace against the first portion of said arch-shaped steel truss, and a second cradle connected to said shank at the second end thereof and shaped to brace against said second portion of the arch-shaped steel truss, and one of said cradles is configured to embrace two adjacent web members of the arch-shaped steel truss at or adjacent a meeting point at which said two web members diverge from one of said arcuate chords.

17. The method of claim 16 including performing said installation of the auxiliary stiffener on the arch-shaped steel truss.

18. A method of customizing an arch-shaped steel truss having a predetermined loading capacity attributed to a prefabricated form of said arch-shaped steel truss that comprises a first arcuate chord, a second arcuate chord and a plurality of existing web members welded to and spanning between said first and second arcuate chords, said method comprising determining load capacity requirements for an intended application of said arch-shaped steel truss, and if said load capacity requirements exceed said predetermined loading capacity, prescribing post-fabrication installation of an auxiliary stiffener to said arch-shaped steel truss in a position bracing against a first portion of the arch-shaped truss situated at or adjacent the first arcuate chord on an inner side thereof, and bracing against a second portion of the arch-shaped truss situated at or adjacent the second arcuate chord on an inner side thereof, in order to augment the existing web members spanning between the first and second arcuate chords of said arch-shaped steel truss, and thereby increase the loading capacity of said arch-shaped steel truss beyond the predetermined loading capacity attributed to the prefabricated form; wherein the intended application for said arch-shaped steel truss is construction of a new truss-based structure, the arch-shaped steel truss is one of a plurality of identical arch-shaped steel trusses each comprised of the same prefabricated form having the same predetermined load capacity, the step of determining load capacity requirements comprises computer-modelling the truss-based structure based on modeled use of an initially selected quantity of said identical arc-shaped steel trusses and identifying from said modeled use one or more particular trusses of anticipated failure in said truss-based structure, and remodeling a revised iteration of said truss-based structure with a total truss quantity equal to said initially selected quantity, but with at least one of the one or more particular trusses of anticipated failure remodeled as a customized truss equipped with the auxiliary stiffener, and based on said remodeling, determining that construction of said revised iteration of the truss-based structure with at least one of said plurality of arc-shaped trusses equipped with the auxiliary stiffener will meet the loading capacity requirements.

19. The method of claim 18 comprising, after said modelling and remodeling of the truss-based structure, physically installing the auxiliary stiffener on the arch-shaped steel truss.

20. The method of claim 19 comprising, after physically installing the auxiliary stiffener on the arch-shaped steel truss, physically erecting an actual truss-based structure based on the modeled revised iteration of the truss-based structure.

21. The combination of claim 14 wherein the first and second cradles are identical.

22. The combination of claim 15 wherein the second cradle is configured to embrace two adjacent web members of the prefabricated truss at or adjacent a meeting point at which said two web members diverge from one of said arcuate chords.

* * * * *